US010070737B2

(12) United States Patent
Leonard et al.

(10) Patent No.: US 10,070,737 B2
(45) Date of Patent: Sep. 11, 2018

(54) PLAY TABLE WITH BRICK TOY WELL

(71) Applicants: Robert Elliott Leonard, Indianapolis, IN (US); William Joseph Leonard, Carmel, IN (US)

(72) Inventors: Robert Elliott Leonard, Indianapolis, IN (US); William Joseph Leonard, Carmel, IN (US)

( * ) Notice: Subject to any disclaimer, the term of this patent is extended or adjusted under 35 U.S.C. 154(b) by 113 days.

(21) Appl. No.: 14/583,379

(22) Filed: Dec. 26, 2014

(65) Prior Publication Data

US 2016/0183675 A1 Jun. 30, 2016

(51) Int. Cl.
*A63H 33/04* (2006.01)
*A47D 3/00* (2006.01)

(52) U.S. Cl.
CPC ..... *A47D 3/00* (2013.01); *A47B 2220/0013* (2013.01)

(58) Field of Classification Search
CPC ..... A63H 33/00; A63H 33/04; B65D 81/365
USPC ..... 446/75, 76, 77, 86, 118, 483
See application file for complete search history.

(56) References Cited

U.S. PATENT DOCUMENTS 1,579,823 A * 4/1926 Langguth ..... A47C 9/022 108/26
2,094,618 A * 10/1937 Pridham ..... A63H 33/3044 212/79
2,199,745 A * 5/1940 Harris ..... A47B 25/00 273/309
2,321,780 A * 6/1943 Tondeur ..... F16C 1/10 242/365.9
3,583,090 A * 6/1971 Fogarty ..... A63H 3/52 108/14
3,721,036 A * 3/1973 Goldfarb ..... A63H 18/14 446/314
3,789,538 A * 2/1974 Spengler ..... A63H 17/44 446/409
4,045,019 A * 8/1977 Wade ..... A63H 33/00 254/376
4,458,440 A * 7/1984 D'Andrade ..... A63H 33/30 446/424
5,055,081 A 10/1991 Nayak
5,218,912 A 6/1993 Buske
5,360,264 A 11/1994 Crane
5,572,934 A * 11/1996 Aldridge ..... A47B 37/00 108/24
5,615,619 A * 4/1997 King ..... A47B 25/00 108/25
D387,583 S * 12/1997 Shear ..... D21/522
5,782,185 A * 7/1998 Frahm ..... A63H 33/00 100/25

(Continued)

OTHER PUBLICATIONS

Screen shot of website created on Dec. 26, 2014 at 11:22:00. http://klevr.us/lego-storage-table.

(Continued)

*Primary Examiner* — Melba Bumgarner
*Assistant Examiner* — Joseph B Baldori
(74) *Attorney, Agent, or Firm* — Dorsey & Whitney LLP

(57) ABSTRACT

The present invention relates to an apparatus comprising a table with a generally horizontal top surface, an opening in the top surface, a receptacle located beneath the opening, a piston located inside the receptacle, and a means for moving the piston from a first vertical position to a second vertical position.

9 Claims, 7 Drawing Sheets

(56) References Cited

U.S. PATENT DOCUMENTS

| | | | | | |
|---|---|---|---|---|---|
| 5,788,350 | A * | 8/1998 | Fladung | A63H 33/04 | 312/244 |
| 5,816,882 | A * | 10/1998 | Guegan | A63H 33/12 | 446/113 |
| 6,152,047 | A * | 11/2000 | MacNamara | B65F 1/1431 | 108/25 |
| 6,321,662 | B1 * | 11/2001 | Fraise | A47B 37/00 | 108/25 |
| 6,406,350 | B2 * | 6/2002 | Yoneda | A63H 17/44 | 446/423 |
| D464,089 | S * | 10/2002 | Studebaker | D21/522 | |
| 6,766,747 | B1 * | 7/2004 | Wolfe | A47B 13/081 | 108/26 |
| 6,802,263 | B1 * | 10/2004 | Kolb | A47B 37/00 | 108/26 |
| 8,176,857 | B2 * | 5/2012 | Ochs | A47B 87/002 | 108/23 |
| 8,317,565 | B2 * | 11/2012 | Shallah | A63H 3/52 | 446/153 |
| 8,528,489 | B2 * | 9/2013 | Roy | A47B 3/08 | 108/125 |
| 9,032,883 | B2 * | 5/2015 | Roy | A47B 3/08 | 108/125 |
| 2005/0176338 | A1 * | 8/2005 | Delaney | A63H 33/04 | 446/92 |
| 2012/0302126 | A1 * | 11/2012 | Yu | A63H 17/21 | 446/57 |

OTHER PUBLICATIONS

Screen shot of website created on Dec. 26, 2014 at 11:23:00. http://www.duffysafetyvending.com/safety-kids-play-centers/.

* cited by examiner

PLAY TABLE WITH BRICK TOY WELL

FIELD

The present disclosure generally involves the field of toys, and more particularly involves a device used in conjunction with the storage and use of modular building brick systems.

BACKGROUND

The present disclosure relates to a play table, and in particular, to a play table for use with the elements of a modular building block system.

Modular building block systems have long been popular toys for children. These systems use certain types of building blocks and toys that detachably snap together. Each such building block or toy is provided with a regular array of cylindrical bumps on one surface and a corresponding regular array of cylindrical recesses on another surface that are adapted to engage with such bumps. Thus by engaging the bumps on one building block or associated toy with the recesses on another such building block or associated toy, the building blocks or associated toys can be detachably snapped together. Generally the systems consist of individual building blocks and associated toys having a variety of sizes and shapes that are designed to interconnect and interlock with one another to form various structures.

The quantity and variety of individual blocks and associated toys utilized in such systems often creates problems for parents when dealing with the clean up of the blocks as well as the storage of the blocks. Children playing with the blocks might spread the blocks and associated toys around a large area, and motivating the child to help collect and store the items for future use is difficult.

Thus, the need exists for a play apparatus that allows for a child to use its surface to help contain the blocks and associated toys as they are being used, but also to help easily store the blocks and associated toys when they are not in use. An additional need exists for the storage apparatus to help motivate or entertain the child to assist in cleaning up and storing the blocks and associated toys, and also to help remove the blocks and associated toys from storage.

BRIEF SUMMARY

The present disclosure addresses these needs by providing a play table with a generally horizontal top surface, an opening in the top surface, a receptacle located beneath the opening, a piston located inside the receptacle, and a means for moving the piston from a first vertical position to a second vertical position.

The features, utilities, and advantages of the various embodiments of the invention will be apparent from the following more particular description of embodiments of the invention as illustrated in the accompanying drawings and defined in the appended claims.

DETAILED DESCRIPTION

Figure 1:
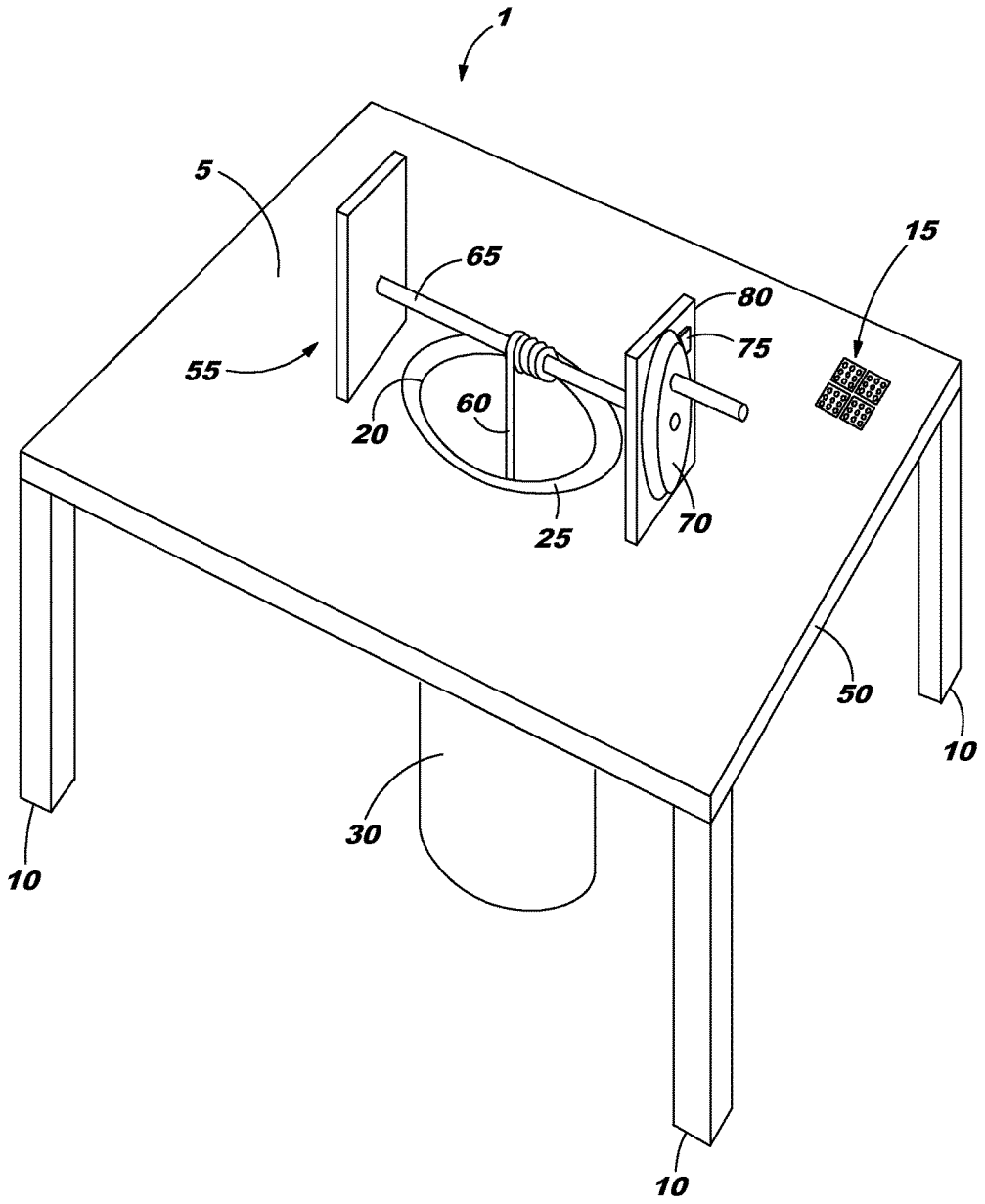
FIG. 1 is an isometric view of the play table in accordance with one embodiment of the present disclosure.

FIG. 1 illustrates an isometric view of one embodiment of the play table in accordance with the present invention. The play table (1) has a generally horizontal top surface (5) that is supported by a plurality of legs (10). Although FIG. 1 depicts the top surface to be supported by four legs (10), any number of legs that will solidly support the surface may be utilized. Likewise, any other support means such as a pedestal base, end panels and the like may be utilized. While the top surface (5) may be supported merely by resting atop one or more boxes, legs, saw horses, pedestals or other support structure, the top surface (5) is preferably secured to the supporting means.

In one embodiment, the top surface (5) may have a plurality of studs (15) that are sized and shaped to interconnect and interlock with individual blocks or associated toys of a modular building block system.

The top surface (5) has an opening (20) therethrough. Although FIG. 1 depicts the top surface (5) having a square shape, it may also be a circle, rectangle, oval or other comparable shape. Although the opening (20) is shown in a central region of the top surface (5), the opening (20) may be located at any position on the top surface (5), such as centered at one end or positioned in a corner. Although FIG. 1 shows a conical surface (25) connecting the top surface (5) and the opening (20), alternative embodiments are contemplated.

The top surface (5) may be bounded along its edges with a border (50). The border (50) may be the same thickness as the top surface (5), or it may be a different thickness than the top surface (5).

Figure 3:
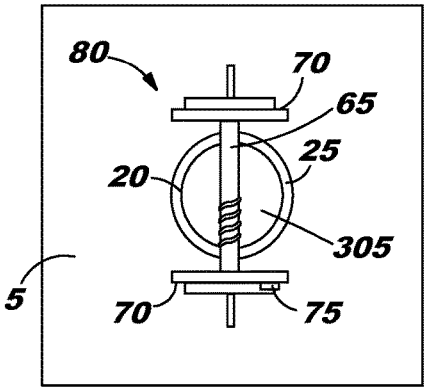
FIG. 3 is a top view of the play table of FIG. 1
Figure 5:
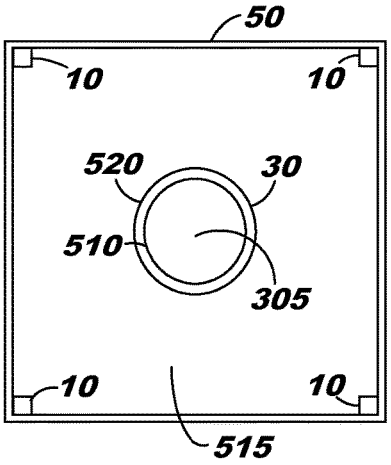
FIG. 5 is a bottom view of the play table of FIG. 1

A receptacle (30) is located beneath the opening (20). In FIG. 1, the receptacle (30) is embodied as a hollow cylinder, however other embodiments of the receptacle (30) can be various shapes such as elliptical, square, rectangular, or an equivalent. A piston (305) cannot be seen in FIG. 1, but is shown in FIGS. 3, 5, and 6. An inside surface of the receptacle (510) cannot be seen in FIG. 1 but is shown in FIGS. 5 and 6. A storage volume is created by the piston (305) and the inside surface (510) of the receptacle (30). The size of the storage volume depends on the vertical location of the piston (305) within the receptacle (30).

Figure 13:
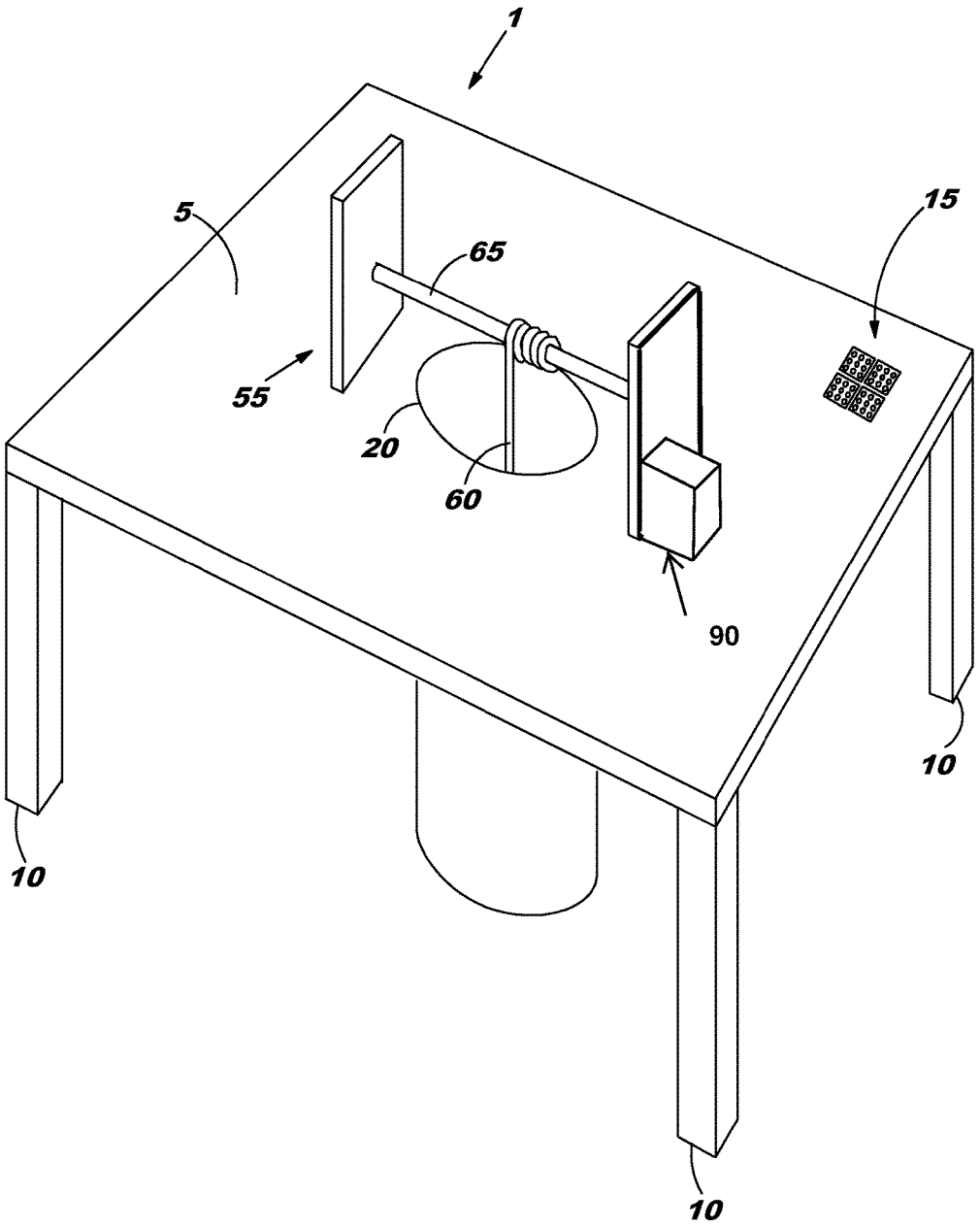
FIG. 13 is an isometric view of an alternate embodiment of a play table with a system for vertically adjusting the piston.

As shown in FIG. 1, one embodiment used as a means for vertically adjusting the piston (55) is a mechanical crank mechanism (80) that can lower and raise the piston (305). A tension member (60) attaches the piston (305) to a crank rod (65) located above the top surface (5). The crank rod (65) is connected to at least one wheel (70), and a child could rotate the wheel (70) of the mechanical crank mechanism (80) in one direction to raise the piston (305) and release the stored blocks and associated toys. Also, the child could use the mechanical crank mechanism (80) to lower the piston (305) to create a volume established by the inside surface (510) of the receptacle (30) and the piston (305) in which to store the blocks and associated toys. Other means contemplated, such as system 90 in FIG. 13, for vertically adjusting the piston (305) include a manually driven gear system, a mechanically driven gear system, an electrically driven gear system, a manually driven belt and pulley system, a mechanically driven belt and pulley system, an electrically driven belt and pulley system, a pneumatic system, a hydraulic system and those systems' equivalents. It is further contemplated that a locking mechanism (75) would be used to maintain the location of the piston (305) such that the piston (305) can be temporarily locked at a certain vertical height.

Figure 2:
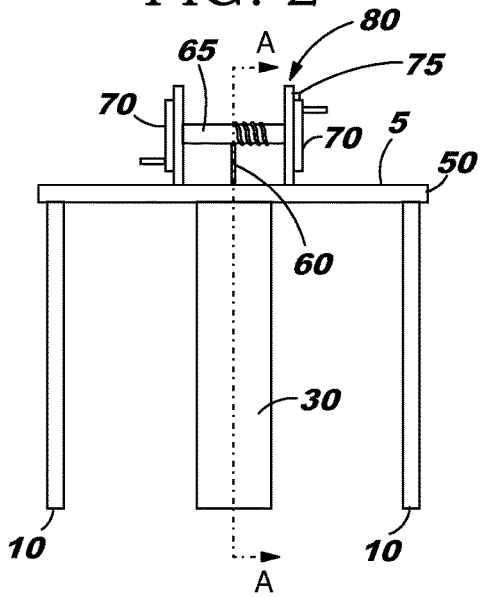
FIG. 2 is a plan view of the play table of FIG. 1
Figure 6A:
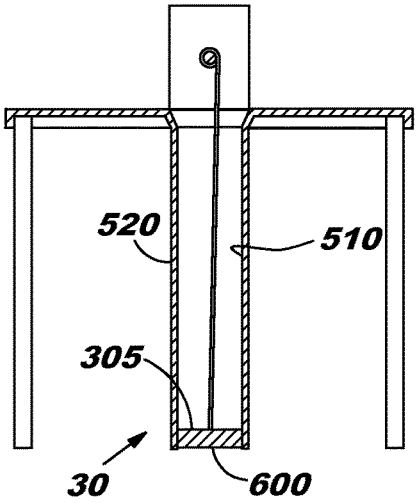
FIG. 6A is a cross-sectional view of the play table shown in FIG. 2.
Figure 6B:
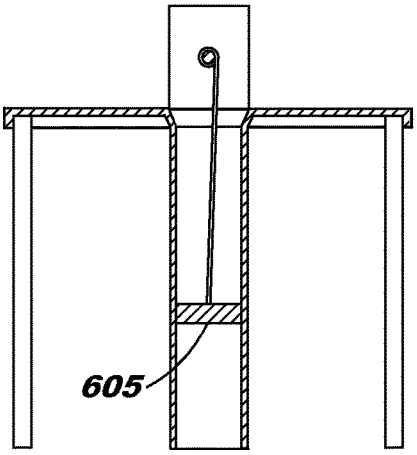
FIG. 6B is a cross-sectional view of the play table shown in FIG. 2.
Figure 6C:
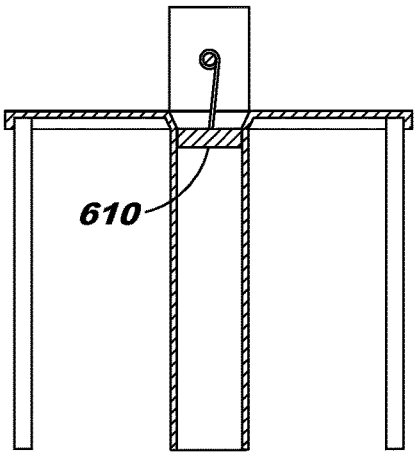
FIG. 6C is a cross-sectional view of the play table shown in FIG. 2.

FIG. 2 shows the front view of the table from FIG. 1, but also notes a reference plane A that is used for cross-sectional views in FIGS. 6A-6C.

FIG. 3 is a top view of the table from FIG. 1, which shows the top surface (5), the conical surface (25), the opening (20) and the piston (305). In this embodiment, the means for vertically adjusting (55) the piston (305) is the mechanical crank mechanism (80) which could sit atop the top surface (5).

Figure 4:
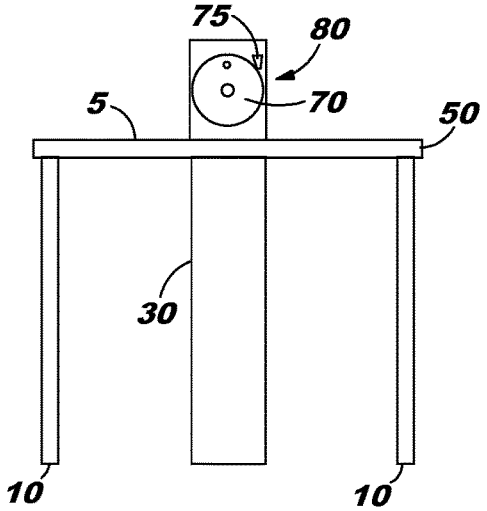
FIG. 4 is a side view of the play table of FIG. 1

FIG. 4 is the side view of the table from FIG. 1.

FIG. 5 is the bottom view of the table in FIG. 1 and includes the bottom surface (515) of the play table, a plurality of legs (10), the piston (305), the inside surface (510) of the receptacle (30), the outside surface (520) of the receptacle (30).

As mentioned above, FIG. 6 also shows the inside surface (510) of the receptacle (30). It is contemplated that the inside surface (510) of the receptacle (30) may be one shape while the outer surface (520) of the receptacle (30) is another. The outer surface (520) of the receptacle (30) is contemplated to have various embodiments including but not limited to shapes that are cylindrical, elliptical, square, rectangular or oblong or the equivalent.

As shown in FIGS. 3, 5 and 6, a piston (305) is located within the receptacle. The piston (305) has the same general shape as the inside surface (510) of the receptacle (30). The piston (305) has a smaller diameter than the inside surface of the receptacle (510) to allow the piston (305) to move to different vertical positions within the receptacle (30).

Once the piston (305) is engaged by the mechanical crank system (80), its upward motion will force any stored blocks and toys upward. At a certain point, the volume of blocks and toys will be larger than the volume formed by the inside surface (510) of the receptacle (30) and piston (305). At this point, the blocks and toys will spill onto the top surface (5) of the play table.

FIGS. 6A-6C show the piston (305) at various vertical heights as adjusted by the means for vertically adjusting the piston (55). FIG. 6A shows the piston (305) at a lower vertical position (600).

FIG. 6B shows the piston (305) at an alternate first vertical position (605). When the piston (305) is at the alternate first vertical position (605) some of the stored building blocks and toys may spill out onto the top surface (5).

FIG. 6C shows the piston (305) at an alternate second vertical position (610). When the piston (305) is at the alternate second vertical position (610), the majority of any stored building blocks and toys will spill out onto the top surface (5). There are an infinite number of positions that can be create between the lower vertical position (600) and the alternate second vertical position (610).

Figure 7:
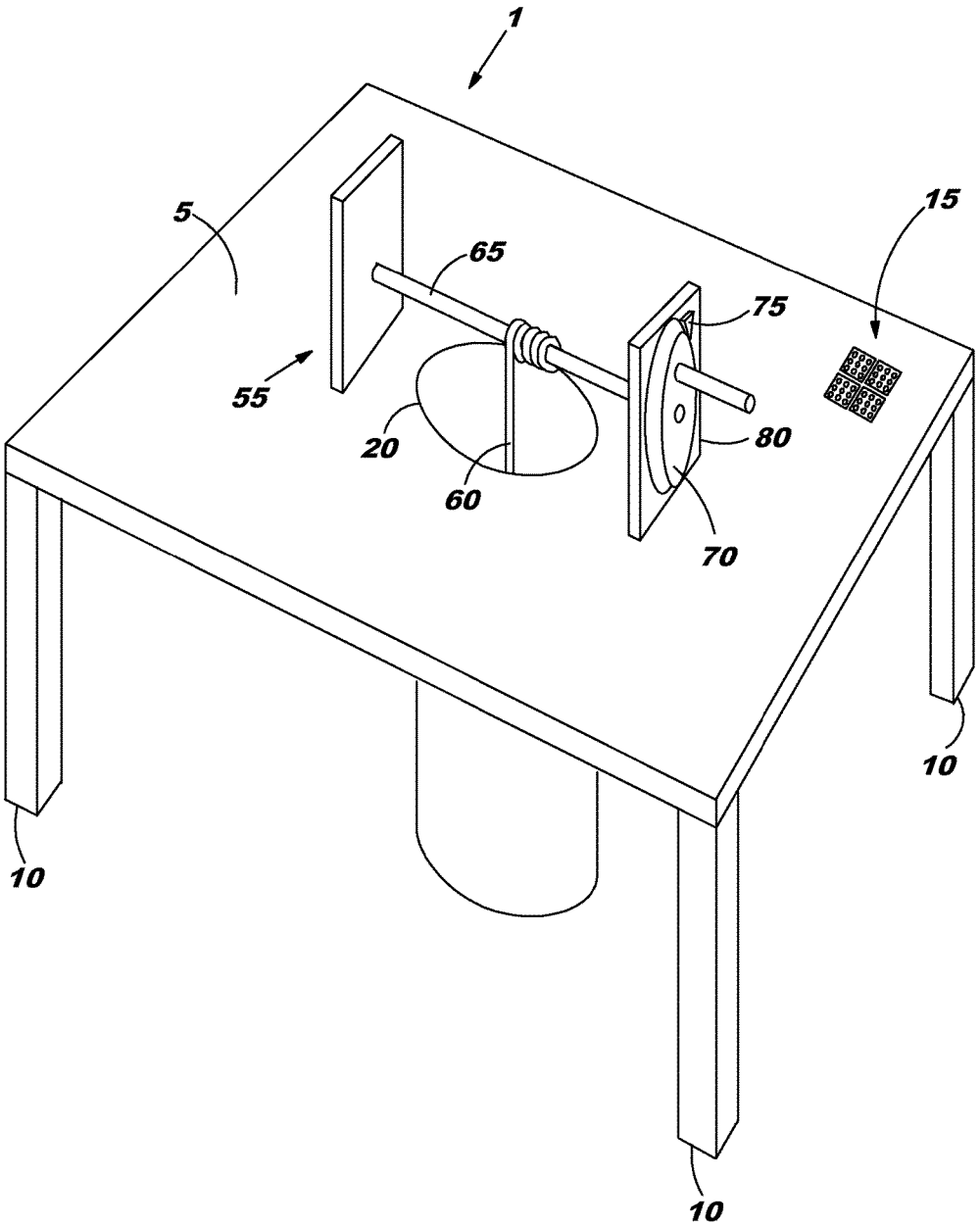
FIG. 7 is an isometric view of the play table in accordance with an alternate embodiment of the present disclosure.

FIG. 7 illustrates an isometric view of an alternate embodiment of the play table in accordance with the present invention. The play table in FIG. 7 encompasses the majority of features of the table shown in FIGS. 1-6, but the top surface (5) and the receptacle (30) are directly connected at the opening (20).

Figure 8:
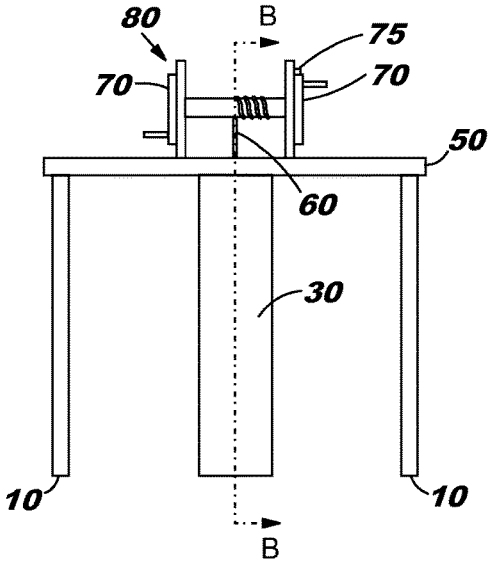
FIG. 8 is a plan view of the play table of FIG. 7
Figure 12A:
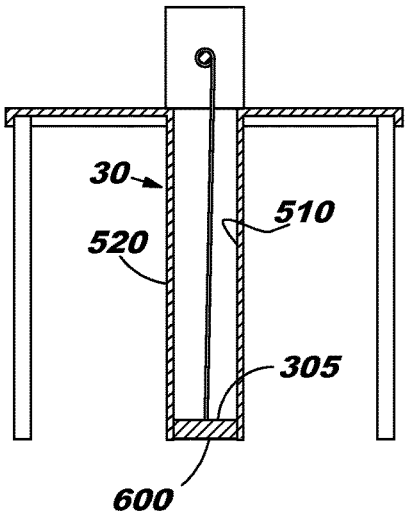
FIG. 12A is a cross-sectional view of the play table shown in FIG. 8.
Figure 12B:
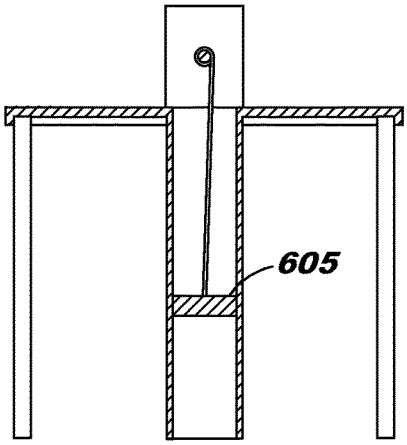
FIG. 12B is a cross-sectional view of the play table shown in FIG. 8.
Figure 12C:
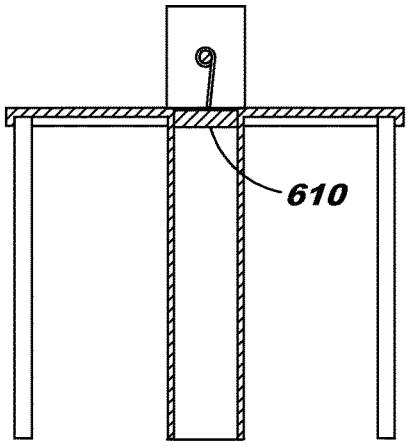
FIG. 12C is a cross-sectional view of the play table shown in FIG. 8.

FIG. 8 shows the front view of the table from FIG. 7 and also notes a reference plane B that is used for cross sectional views in FIGS. 12A-12C.

Figure 9:
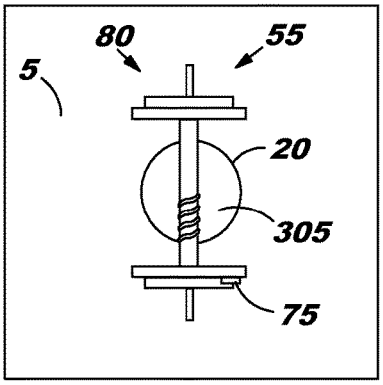
FIG. 9 is a top view of the play table of FIG. 7

FIG. 9 is a top view of the table from FIG. 7 that shows the top surface (5), the opening (20), and the piston (305). In this embodiment, the means for vertically adjusting (55) the piston (305) is the mechanical crank mechanism (80) that could sit atop the top surface (5).

Figure 10:
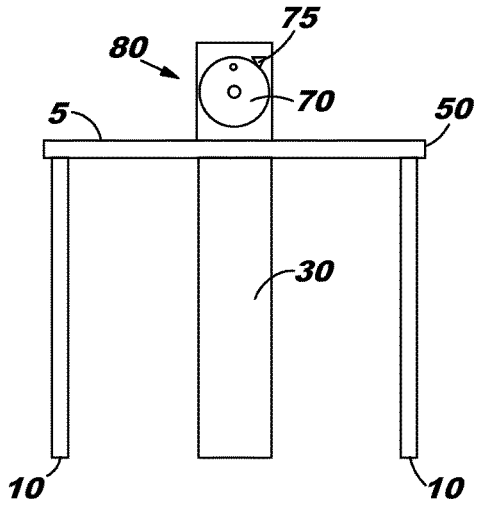
FIG. 10 is a side view of the play table of FIG. 7

FIG. 10 is the side view of the table from FIG. 7.

Figure 11:
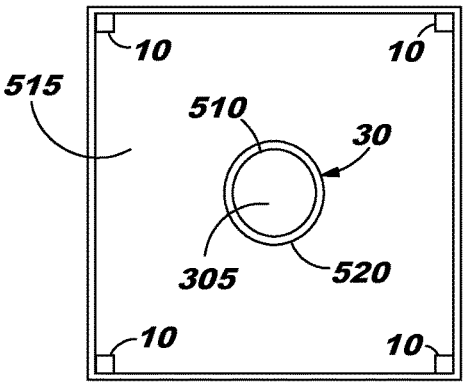
FIG. 11 is a bottom view of the play table of FIG. 7

FIG. 11 is the bottom view of the table in FIG. 7 and includes the bottom surface (515) of the play table, a plurality of legs (10), the piston (305), the inside surface (510) of the receptacle (30), the outside surface (520) of the receptacle (30).

FIGS. 12A-12C also show the inside surface (510) of the receptacle (30). The inside surface (510) of the receptacle (30) may be one shape while the outer surface (520) of the receptacle (30) is another. This would allow for manufacturing to be streamlined to utilize already existing tooling. FIGS. 12A-12C shows the piston (305) at various vertical heights as adjusted by the means for vertically adjusting (55) the piston (305).

FIG. 12A shows the piston (305) at a lower vertical position (600).

FIG. 12B shows the piston (305) at an alternate first vertical position (605). When the piston (305) is at the alternate first vertical position (605) some of the stored building blocks and toys may spill out onto the top surface (5).

FIG. 12C shows the piston (305) at an alternate second vertical position (610). When the piston (305) is in the alternate second vertical position (610), there is no longer any type of storage created by the piston (305) and the inside surface (510) of the receptacle (30) and the stored building blocks and toys will spill out onto the top surface (5) and sit upon the piston (305). There are an infinite number of positions that can be created between the lower vertical position (600) and the alternate second vertical position (610).

Although various representative embodiments of this disclosure have been described above with a certain degree of particularity, those skilled in the art could make numerous alterations to the disclosed embodiments without departing from the spirit or scope of the inventive subject matter set forth in the specification and claims. All direction references (e.g., upper, lower, upward, downward, left, right, leftward, rightward, top, bottom, above, below, vertical, horizontal, clockwise and counterclockwise) are only used for identification purposes to aid the reader's understanding of the embodiments of the present disclosure, and do not create limitations, particularly as to the position, orientation, or use of the disclosure unless specifically set forth in the claims. Joinder references (e.g., attached, coupled, connected and the like) are to be construed broadly and may include intermediate members between a connection of elements and relative movement between elements. As such, joinder references do not necessarily infer that two elements are directly connected and in fixed relation to each other. In some instances, components may be described with reference to "ends" having a particular characteristic and/or being connected with another part. However, those skilled in the art will recognize that the present invention is not limited to components that terminate immediately beyond their points of connection with other parts. Thus, the term "end" should be interpreted broadly, in a manner that includes areas adjacent rearward, forward of, or otherwise near the terminus of a particular element, link, component, part, member of the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

The invention claimed is:

1. A toy storage system comprising:

a table including an upper surface and a lower surface with a fixed-size opening defined in a central region of the upper surface and lower surface, the fixed-size opening being accessible;

a receptacle including an inside surface located beneath the opening;

a piston defining a support surface normal to the inside surface and adjacent the opening and moveably received within the receptacle and moveable relative to the inside surface and selectively adjustable to various positions within the receptacle, wherein the entire fixed-size opening and the entire upper surface remain unobstructed and accessible at each of the various positions and the support surface is accessible at a lowest position;

a mechanism positioned on the upper surface of the table adjacent the opening and coupled with the surface, the mechanism comprising a wheel, a crank rod, and a tension member, the wheel directly coupled with the crank rod and configured to be rotated, the tension member directly coupled with the crank rod and support surface of the piston;

wherein a rotation of the wheel wraps the tension member around the crank rod and increases a vertical position of the piston;

the inside surface of the receptacle and the support surface of the piston in a first vertical position form a storage compartment configured to store toy building elements; and the upper surface defines a plurality of upwardly extending studs.

2. The toy storage system of claim 1, wherein when the support surface of the piston is in a second vertical position, the surface of the table and the support surface are adjacent each other.

3. The toy storage system of claim 1, further comprising an intermediate section between the receptacle and the surface of the table, wherein the intermediate section is conically shaped.

4. The toy storage system of claim 3, wherein:

the conically shaped intermediate section comprises a first diameter with a first edge and a second diameter with a second edge, the second diameter being smaller than the first diameter; and wherein in a second vertical position, the support surface of the piston is adjacent the second edge of the conical region.

5. The toy storage system of claim 1, wherein the inside surface of the receptacle and the support surface of the piston in an alternate vertical position create a smaller storage compartment.

6. The toy storage system of claim 1, wherein the support surface of the piston in an alternate vertical position is adjacent the upper surface of the table and the storage compartment no longer exists.

7. The toy storage system of claim 1, further comprising a locking mechanism to maintain the position of the piston at the various position within the receptacle.

8. The toy storage system of claim 1, wherein the fixed size opening is has an effective opening that remains unobstructed regardless of the position of the support surface of the piston.

9. The device of claim 1, wherein the crank rod has a proximal and distal end, the proximal end extending through the wheel and configured to be grasped.

* * * * *